US011217895B2

(12) United States Patent
Kelly et al.

(10) Patent No.: US 11,217,895 B2
(45) Date of Patent: Jan. 4, 2022

(54) TUNEABLE WAVEGUIDE TRANSITION

(71) Applicant: Arralis Holdings Limited, Hong Kong (CN)

(72) Inventors: Mark Kelly, Bundoran (IE); Denver Humphrey, Ballymena (GB); Michael Gleaves, Castleroy (IE)

(73) Assignee: Arralis Holdings Limited, Kowloon (HK)

( * ) Notice: Subject to any disclaimer, the term of this patent is extended or adjusted under 35 U.S.C. 154(b) by 142 days.

(21) Appl. No.: 16/469,044

(22) PCT Filed: Dec. 14, 2017

(86) PCT No.: PCT/EP2017/082938
§ 371 (c)(1),
(2) Date: Jun. 12, 2019

(87) PCT Pub. No.: WO2018/109136
PCT Pub. Date: Jun. 21, 2018

(65) Prior Publication Data

US 2019/0372232 A1 Dec. 5, 2019

(30) Foreign Application Priority Data

Dec. 15, 2016 (EP) ..... 16204526

(51) Int. Cl.
*H01Q 13/08* (2006.01)

(52) U.S. Cl.
CPC ..... *H01Q 13/085* (2013.01)

(58) Field of Classification Search
CPC ..... H01Q 13/085; H01P 5/107
See application file for complete search history.

(56) References Cited

U.S. PATENT DOCUMENTS

| | | | | |
|---|---|---|---|---|
| 5,268,696 | A | 12/1993 | Buck et al. | |
| 6,501,431 | B1 * | 12/2002 | Irion, II | H01Q 13/08 343/767 |
| 9,490,518 | B1 * | 11/2016 | Herbsommer | H01Q 1/24 |
| 2008/0023632 | A1 * | 1/2008 | Ridgway | G02F 1/065 250/338.1 |
| 2011/0148725 | A1 * | 6/2011 | Cavener | H01Q 13/085 343/770 |

(Continued)

FOREIGN PATENT DOCUMENTS

| | | |
|---|---|---|
| CN | 101217216 | 7/2008 |
| JP | 2006502640 | 12/2008 |

(Continued)

OTHER PUBLICATIONS

"Notification of Transmittal of The International Search Report and The Written Opinion of the International Searching Authority, or the Declaration," dated Mar. 13, 2018 for International Application No. PCT/EP2017/082938 (12 pages).

(Continued)

*Primary Examiner* — Daniel Munoz
(74) *Attorney, Agent, or Firm* — Renner Kenner Greive Bobak Taylor & Weber

(57) ABSTRACT

The present invention provides a transition for millimetre wave circuits. The transition comprises a tapered slot antenna and a microstrip feed line coupled to the antenna. The transition is adapted to provide a tuneable frequency response.

12 Claims, 9 Drawing Sheets

(56) References Cited

U.S. PATENT DOCUMENTS

2012/0313832 A1 12/2012 Pazin et al.

FOREIGN PATENT DOCUMENTS

| | | | |
|---|---|---|---|
| JP | 2010509611 | | 3/2010 |
| WO | 03058758 | A1 | 7/2003 |
| WO | 2011095969 | | 8/2011 |
| WO | 2011095969 | A1 | 8/2011 |
| WO | 2016141177 | A1 | 9/2016 |
| WO | 2018109136 | A1 | 6/2018 |

OTHER PUBLICATIONS

Compact wideband single-ended and differential microstrip-to-waveguide transitions at W-band; M. Giese et al.; 2015 IEEE MTT-S International Microwave Symposium.
High-gain triple-band reconfigurable Vivaldi antenna; C. Borda Fortuny et al.; 2014 IEEE-APS Topical Conference on Antennas and Propagation in Wireless Communications (APWC).
Reconfigurable dual frequency microstrip patch antenna using RF MEMS switches; J. DeSignor et al.; Google Scholar.
Japanese Office Action dated Oct. 26, 2021.

* cited by examiner

TUNEABLE WAVEGUIDE TRANSITION

This application is the U.S. National Stage of International Application No. PCT/EP2017/082938, filed Dec. 14, 2017, which designates the U.S., is published in English, and claims priority under 35 U.S.C. § 119 or 365(c) to European Application No. 16204526.4, filed Dec. 15, 2016. The entire teachings of the above applications are incorporated herein by reference.

FIELD

The present invention relates to a transition for a waveguide circuit. More particularly, the invention relates to a tuneable transition for a millimetre wave or a sub millimetre wave waveguide circuit.

BACKGROUND

In millimetre or sub millimetre wave applications, the transfer of signal energy between conductive media and airborne media requires the use of a transition or probe.

One type of probe which is commonly used to perform such a function is a dipole. The dipole is inserted into a waveguide at a determined point and provides broadband performance. However, one drawback of a dipole is that it must be inserted at the side of a waveguide. It also requires a supporting quarter wavelength cavity in order to be effective.

Another type of probe which is used for millimetre wave applications is the tapered slot (Vivaldi) antenna. This antenna comprises a slot with a constant taper on a planar substrate. A microstrip line provides the feed for the slot. The tapered slot is an in-line transition, and therefore not as disruptive to the design process as a dipole. However, this antenna suffers from the drawback that the pass band of the antenna is not tuneable.

It is an object of the present invention to overcome at least one of the above mentioned problems.

SUMMARY

According to the invention, there is provided, as set out in the appended claims, a transition for millimetre wave circuits comprising: a tapered slot antenna; a microstrip feed line coupled to the antenna; and a set of tuning pads for coupling to the microstrip feed line so as to provide a tuneable frequency response.

In an embodiment, the microstrip feed line is located in-line with the direction of the slot of the antenna.

In an embodiment, the tapered slot comprises a curved taper, and wherein the slot comprises a short-circuit end adjacent the feed line and a radiating end, and wherein the slot tapers outwardly from the short-circuit end towards the radiating end.

In an embodiment, the profile of the curve of the taper is defined by the use of at least two different equations.

In an embodiment, the profile of the curve of the taper is defined by the use of following three equations:

1. Curved Expression: $f(x)=a/(1+e^{-b(x-c)})$

2. Curved Expression: $f(x)=ke^{l(x)}+n$

3. Linear Expression: $f(x)=mx+C$ wherein f(x) and x correspond to distances from a zero plane and the curve is defined by adjusting the curve above the point of inflection of equation 1 to curve upwards using equation 2, and the curve below the point of inflection of equation 1 is integrated into the short circuit end of the slot using equation 3.

In an embodiment, the microstrip feed line comprises a main microstrip feed line coupled to an open circuit impedance stub.

In an embodiment, the set of tuning pads comprise a first set of tuning pads located adjacent to the main microstrip feed line, wherein the centre frequency and the frequency band of the transition is tuneable by the selective coupling of the first set of tuning pads to the main microstrip feed line.

In an embodiment, the transition further comprises a second set of tuning pads located adjacent to the open circuit impedance stub, wherein the insertion loss in the frequency band is fine tuneable by the selective coupling of the second set of tuning pads to the open circuit impedance stub.

In an embodiment, the first and the second set of tuning pads are selectively coupled to the microstrip feed line by means of wire bonding.

In an embodiment, the transition is formed on a planar substrate.

In an embodiment, the microstrip feed line is formed on a top conductive pattern of the substrate, and the tapered slot antenna is formed on a bottom conductive pattern of the substrate.

In an embodiment, the transition is tuneable to increase or decrease its centre frequency.

The present invention also provides a waveguide sub-system for mounting onto a waveguide channel comprising the transition mounted to a carrier.

In an embodiment, the carrier comprises a slot carrier.

In an embodiment, active devices are mountable to the carrier.

In an embodiment, the sub-system is mountable onto a waveguide channel by means of one of: epoxy or soldering or a screw fixing.

The present invention also provides a filter comprising:

a first transition and a second transition; wherein the first transition and the second transition are mounted back to back onto a microstrip.

The present invention also provides a transition for millimetre wave circuits comprising: a tapered slot antenna; and a microstrip feed line coupled to the antenna; wherein the transition is adapted to provide a tuneable frequency response.

BRIEF DESCRIPTION OF THE DRAWINGS

The invention will be more clearly understood from the following description of an embodiment thereof, given by way of example only, with reference to the accompanying drawings, in which:—

DETAILED DESCRIPTION OF THE DRAWINGS

Figure 1:
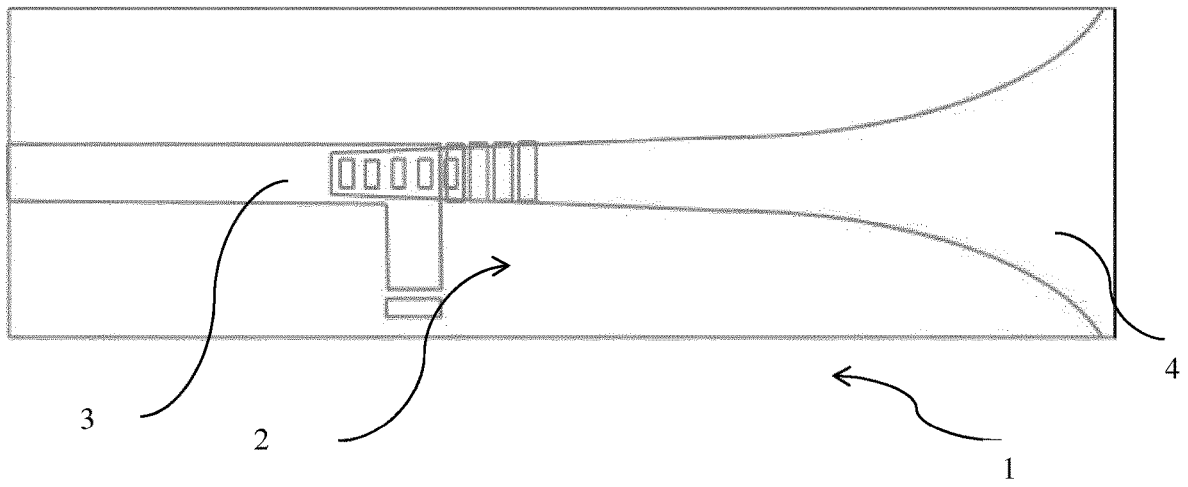
FIG. 1 shows a top view of the transition of the present invention.

The present invention comprises a transition for millimetre or sub millimetre wave applications which is adapted to provide a tuneable frequency response. As shown in FIGS. 1 to 6, the transition, which is generally indicated by the reference numeral 1, comprises a tapered slot antenna 2 and a feed line 3 coupled to the antenna 2. The transition 1 is formed on a planar substrate 4, such as for example quartz.

Figure 2:
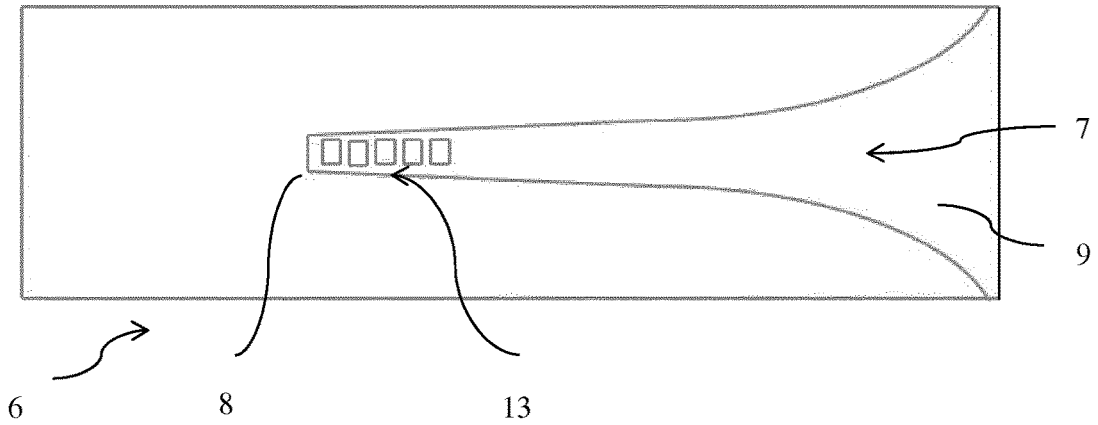
FIG. 2 shows the bottom conductor pattern of the transition of FIG. 1.
Figure 3:
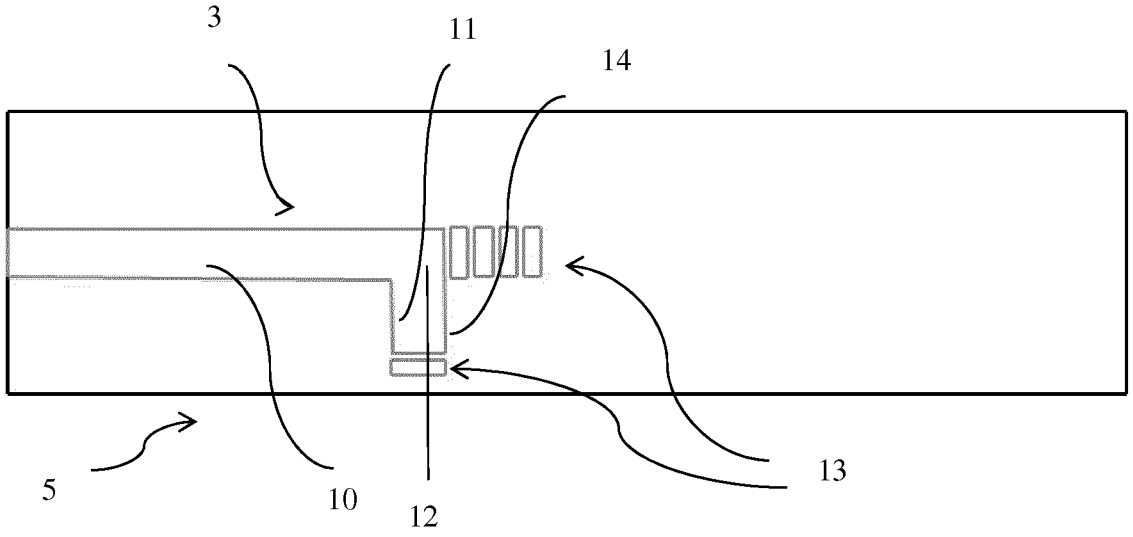
FIG. 3 shows the top conductor pattern of the transition of FIG. 1.

The transition 1 is formed from top 5 and bottom 6 conductive patterns on the substrate 4, as shown in FIGS. 2 and 3. The feed line 3 comprises a microstrip feed line formed on the top conductive pattern 5 which forms the conductive signal layer. The guided wave portion of the transition 1 provided by the tapered slot antenna 2 is formed on the bottom conductive pattern 6, which forms the ground plane.

The tapered slot 7 of the antenna 2 comprises a short-circuit end 8 and a radiating end 9. The slot 7 tapers outwardly from the short-circuit end 8 towards its radiating end 9. The microstrip feed line 3 couples the signal feed to the slot 7 with the feed line 3 located in-line with the direction of the slot 7. As shown in FIG. 3, the feed line 3 is substantially L shaped, and comprises a main microstrip line 10 coupled to an open circuit impedance stub 11. The end portion 12 of the main microstrip line 10 is located longitudinal to the direction of the slot 7 and on top of that portion of the slot 7 which is proximate to its short-circuit end 8. The open circuit impedance stub 11 is located perpendicular to the direction of the slot 7 as well as the end portion 12 of the main microstrip line 10. Thus, the location of the microstrip feed line 3 on the transition 1 results in an in-line and centred transition 1.

A plurality of tuning stubs or pads 13 are provided on the transition 1 to enable the centre frequency and frequency band of the transition 1 to be tuned with minimum insertion loss. These tuning pads 13 are formed on both the top conductive pattern 5 and the bottom conductive pattern 6 adjacent the microstrip feed line 3.

A first set of tuning pads are located in a single row in line with the end portion 12 of the main microstrip line 10. This set of tuning pads are selectively coupled to the main microstrip line 10 in order to provide the necessary frequency tuning. The coupling may be provided by any suitable means, such as for example by wire bonding.

Figure 4:
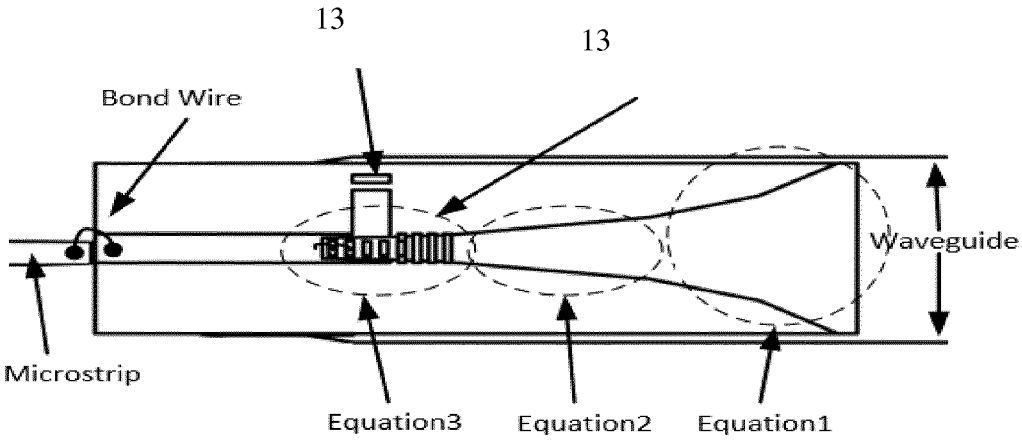
FIG. 4 is another top view of the transition of the present invention illustrating how the profile of the curve is formed from different equations.
Figure 5:
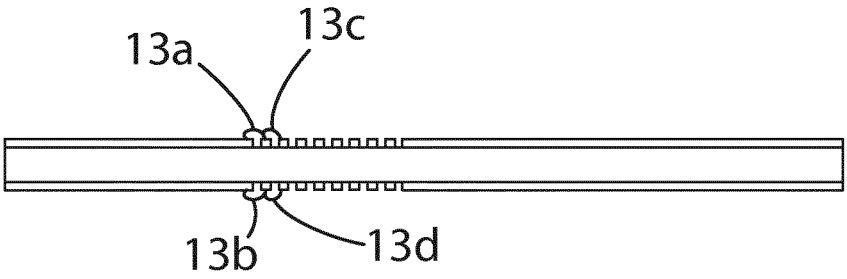
FIG. 5 shows a side view of FIG. 4.
Figure 6:
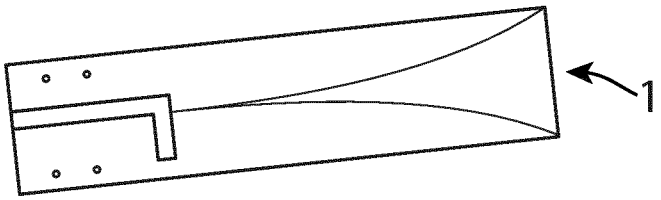
FIG. 6 shows a photo of the transition of FIG. 1.

FIGS. 4 and 5 show an example of the selective coupling of the first set of tuning pads to the main microstrip line 10. It can be seen from these figures that a first tuning pad 13*a* located closest to the main microstrip line 10 on the top conductive pattern 5 is bonded both to a tuning pad 13*b* located on the bottom conductive pattern 6 as well as to the main microstrip line 10. In the same manner, a second tuning pad 13*c* located on the top conductive pattern 5 adjacent to the first tuning pad 13*a* is bonded both to a tuning pad 13*d* on the bottom conductive pattern 6 as well as to the first tuning pad 13*a*. This bonding process may be repeated as necessary in respect of each tuning pad 13 provided on the top conductive pattern 5 until the lowest loss at the frequency of interest is achieved. It will be appreciated that this selective coupling of the tuning pads 13 to the main microstrip line 10 manipulates the short circuit by changing the position and the structure of the magnetic field in the transition 1. Accordingly, by appropriate coupling of the tuning pads 13 to the main microstrip line 10, the transition 1 may be tuned to both increase and decrease the centre frequency.

In the described embodiment of the invention, a second set of tuning pads 13 are also provided adjacent the open circuit impedance stub 11 for fine tuning the insertion loss in the frequency band. These tuning pads 13 are located in a single row in line with the end 14 of the open circuit impedance stub 11. By adjusting the length of the open circuit impedance stub 11 through the selective coupling of the second set of tuning pads 13 to the stub 11 in a similar manner to that described above in relation to the first set of tuning pads, the depth of the short circuit of the transition 1 can be varied, and thus the insertion loss can be minimised. It should be noted that this tuning of the insertion loss in the frequency band has a minimal effect on the bandwidth.

It should be noted that it is not necessary that the number of tuning pads on the top conductive pattern 5 match the number, size or position of the tuning pads on the bottom conductive pattern 6.

In accordance with the present invention, the slot 7 comprises a curved taper having a profile which is defined by multiple equations. By using more than one equation to define the profile of the electromagnetic wave slot curve, the length of the transition) may be minimised. In addition, it enables the centre frequency and the bandwidth of the transition 1 to be manipulated during fabrication to predetermined desired values. This is due to the fact that the position and shape of the short circuit is crucial to the centre frequency and bandwidth of the transition 1, as previously explained.

In one embodiment of the invention, the profile of the curve is defined by the use of the following three equations:

$$f(x)=a/(1+e^{-b(x-c)})$$ 1. Curved Expression:

$$f(x)=ke^{l(x)}+n$$ 2. Curved Expression:

$$f(x)=mx+C$$ 3. Linear Expression:

The variables f(x) and x in the equations correspond to distances from a zero plane. The values of the constants in the equations are adjustable in accordance with the required performance and size of the transition. For example, in one embodiment equation 3 for the linear curve could be designed to provide a considerable gradient, while equation 1 for the radiating end of the taper could be designed to provide an extended flare.

As shown in FIG. 4, the curve is defined by adjusting the curve above the point of inflection of expression 1 to curve upwards using expression 2. In addition, the curve below the point of inflection of expression 1 was integrated into the slot parameters to the short-circuit end 8 of the slot 7 using the straight line expression 3. Accordingly, expression 3 provides the connection from the microstrip to the transition 1. In an alternative embodiment, the profile of the curve could be defined by the use of expression 1 and expression 2 only. However, the use of expression 3 has been found to further improve the performance of the transition 1.

Figure 7:
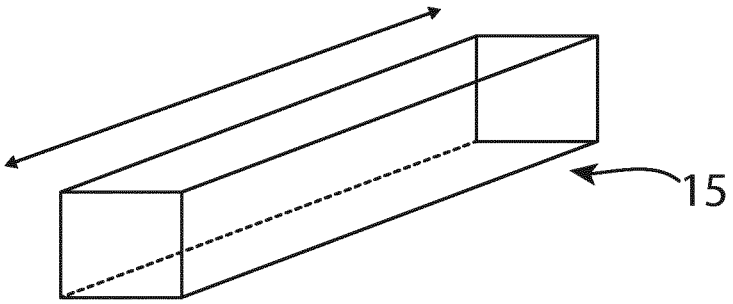
FIG. 7 shows one embodiment of a carrier to which the transition of the invention may be mounted.
Figure 8:
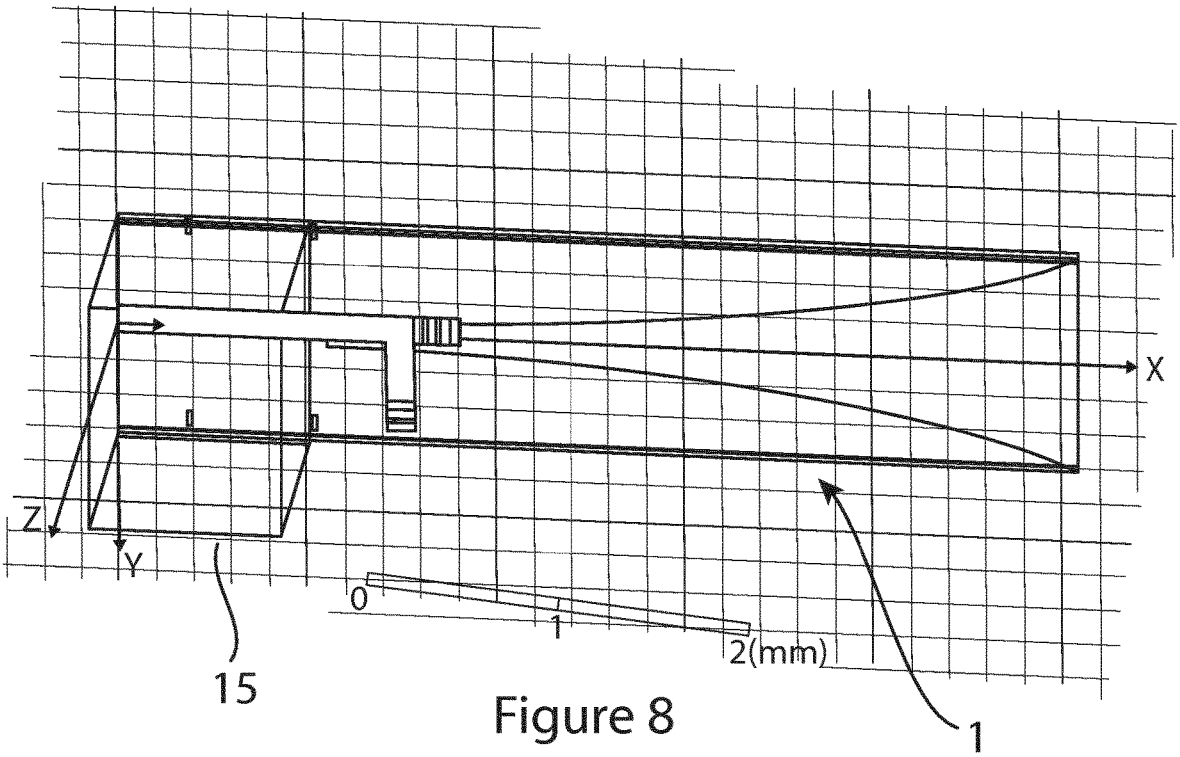
FIG. 8 shows the transition of FIG. 1 attached to the carrier of FIG. 7.

The transition 1 is typically mounted to a carrier prior to insertion into a waveguide. It can be mounted to the carrier through any suitable means, such as for example by means of die bonding. In one embodiment of the invention, the transition is die bonded to a section of a metal slot carrier 15 which has been machined to fit into a particular waveguide channel, as shown in FIGS. 7 and 8. Such a carrier 15 is suitable for inserting passive structures, such as for example filters. The slot carrier 15 may be inserted into a waveguide channel at any position of the straight part of the channel, and can be fixed into position, for example via epoxy or soldering (not shown).

Figure 9:
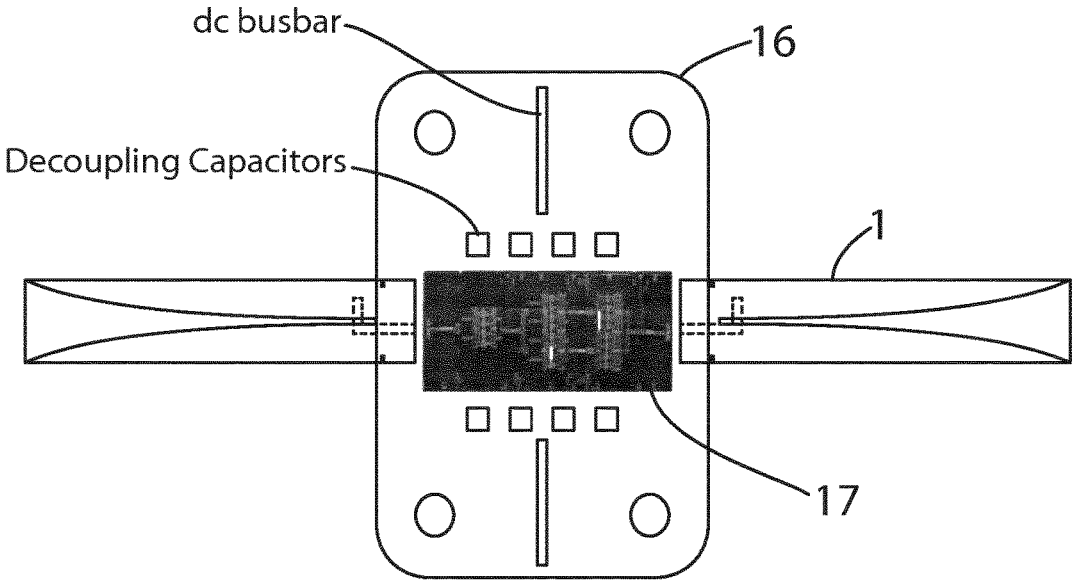
FIG. 9 shows another embodiment of a carrier to which the transition of the invention may be mounted.
Figure 10:
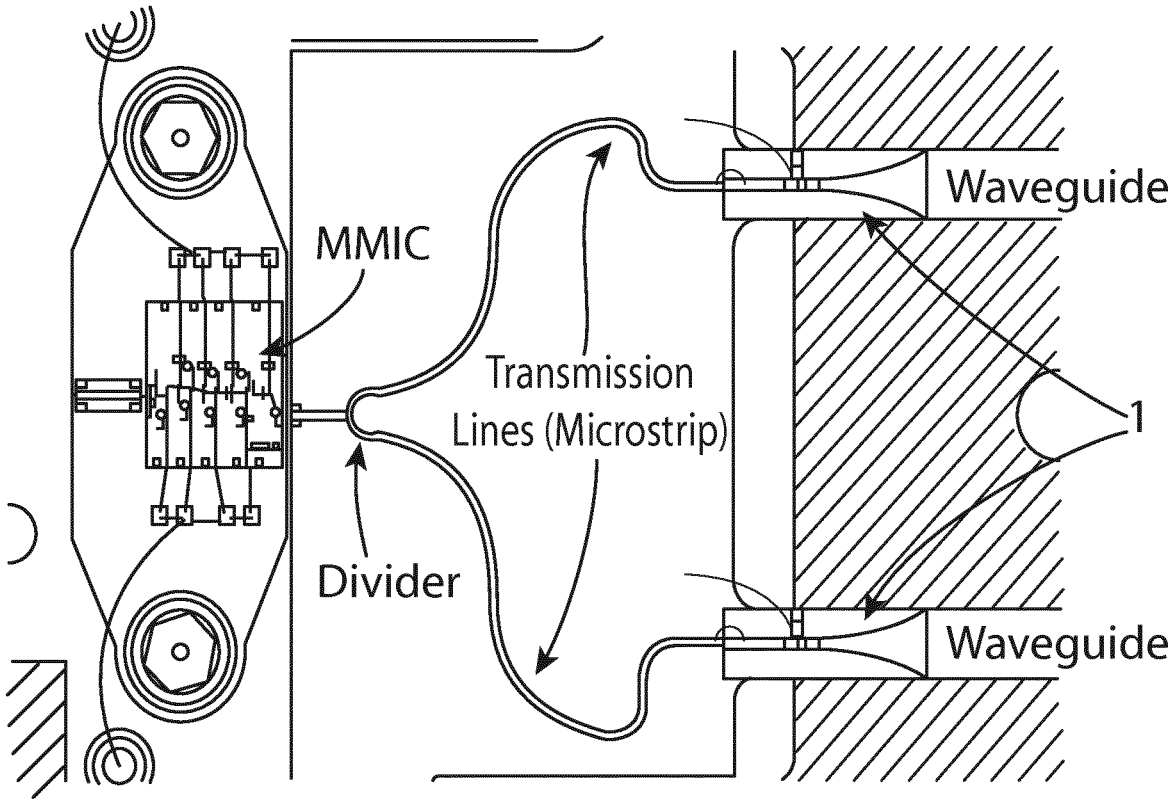
FIG. 10 shows how two transitions of the present invention could be applied to a typical circuit.

In the case where it is desired to populate both active and passive devices on the same carrier, a carrier 16 of the type shown in FIG. 9 could alternatively be used with the transition 1. As can be seen from this figure, this carrier 16 is adapted to enable the mounting of an active device 17 adjacent to two transitions 1. The carrier 16 may be screwed into place on the casing of a waveguide channel (not shown). FIG. 10 illustrates how two transitions of the present invention could be applied to a typical circuit. In this figure, it can be seen that two transitions are connected via separate microstrips to a MMIC via a divider.

Figure 11I:
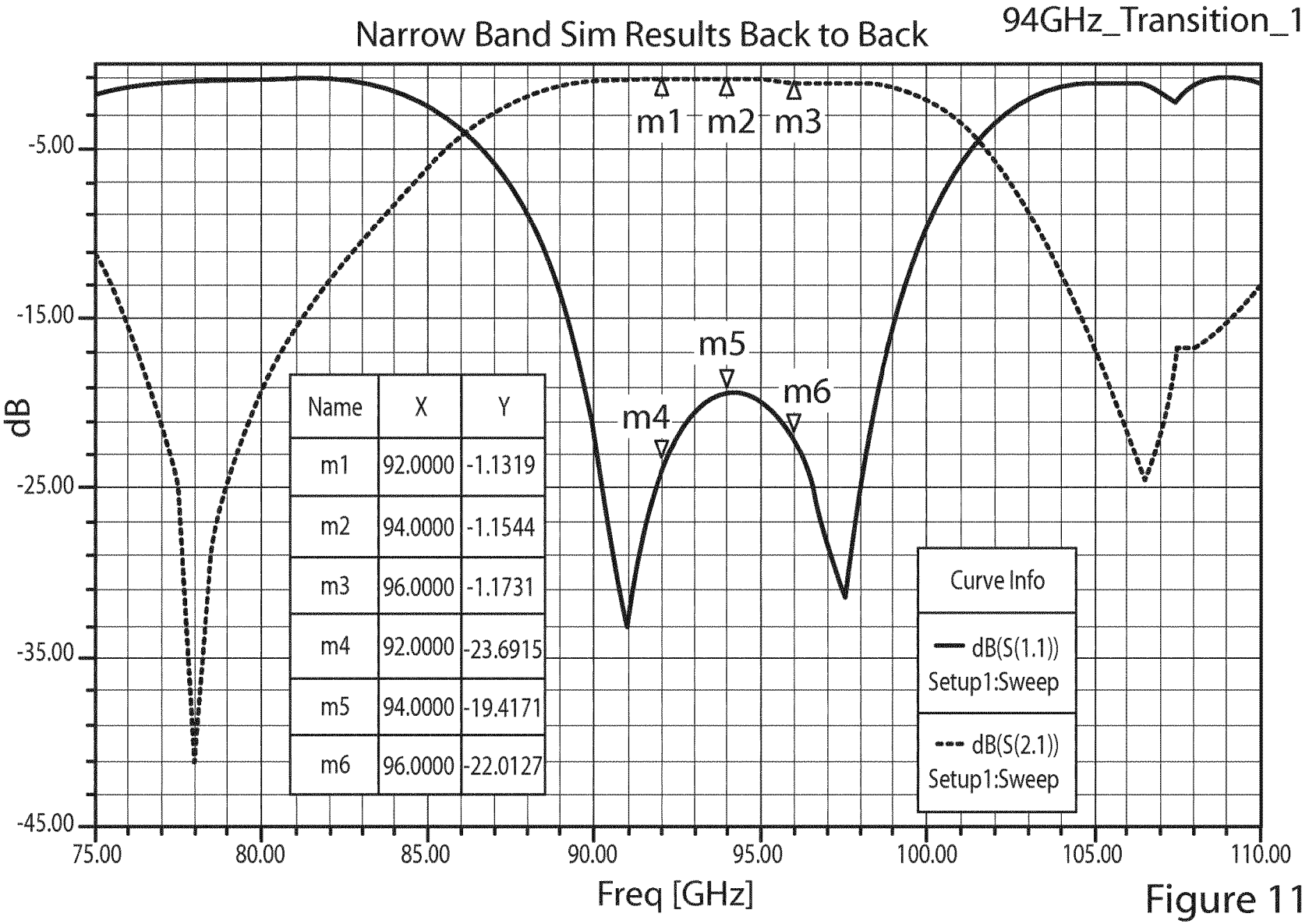
FIG. 11(*i*) shows the simulated and FIG. 11(*ii*) the measured performance of two transitions of the present invention mounted back to back onto the carrier of FIG. 7 and attached to a waveguide channel.
Figure 11:
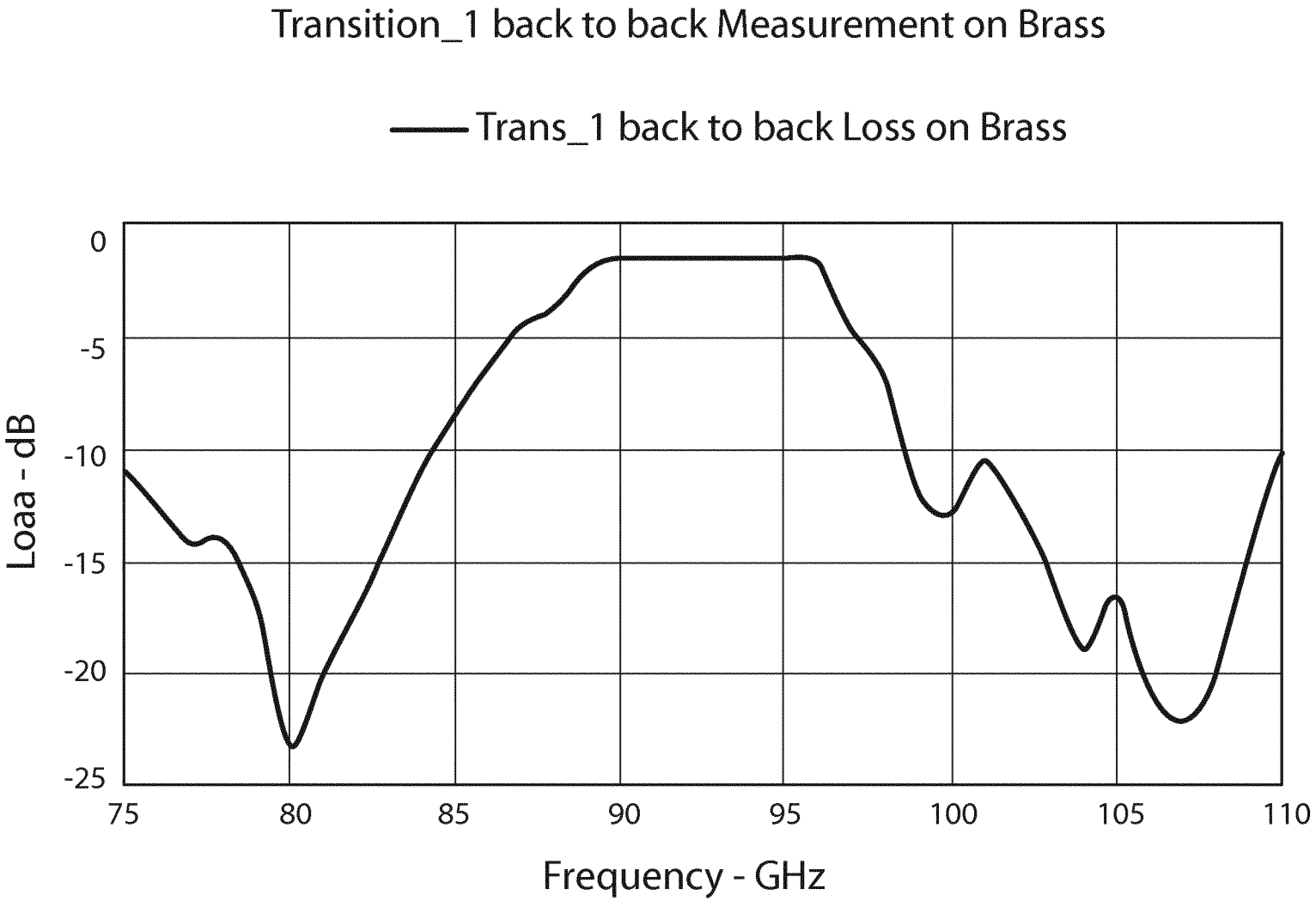

FIG. 11 shows (i) the simulated and (ii) the actual performance of two transitions of the invention, wire bonded together and mounted onto a slot carrier, when the carrier is attached to a waveguide. The in band and out of band performance of the structure can be seen clearly from this figure.

Figure 12:
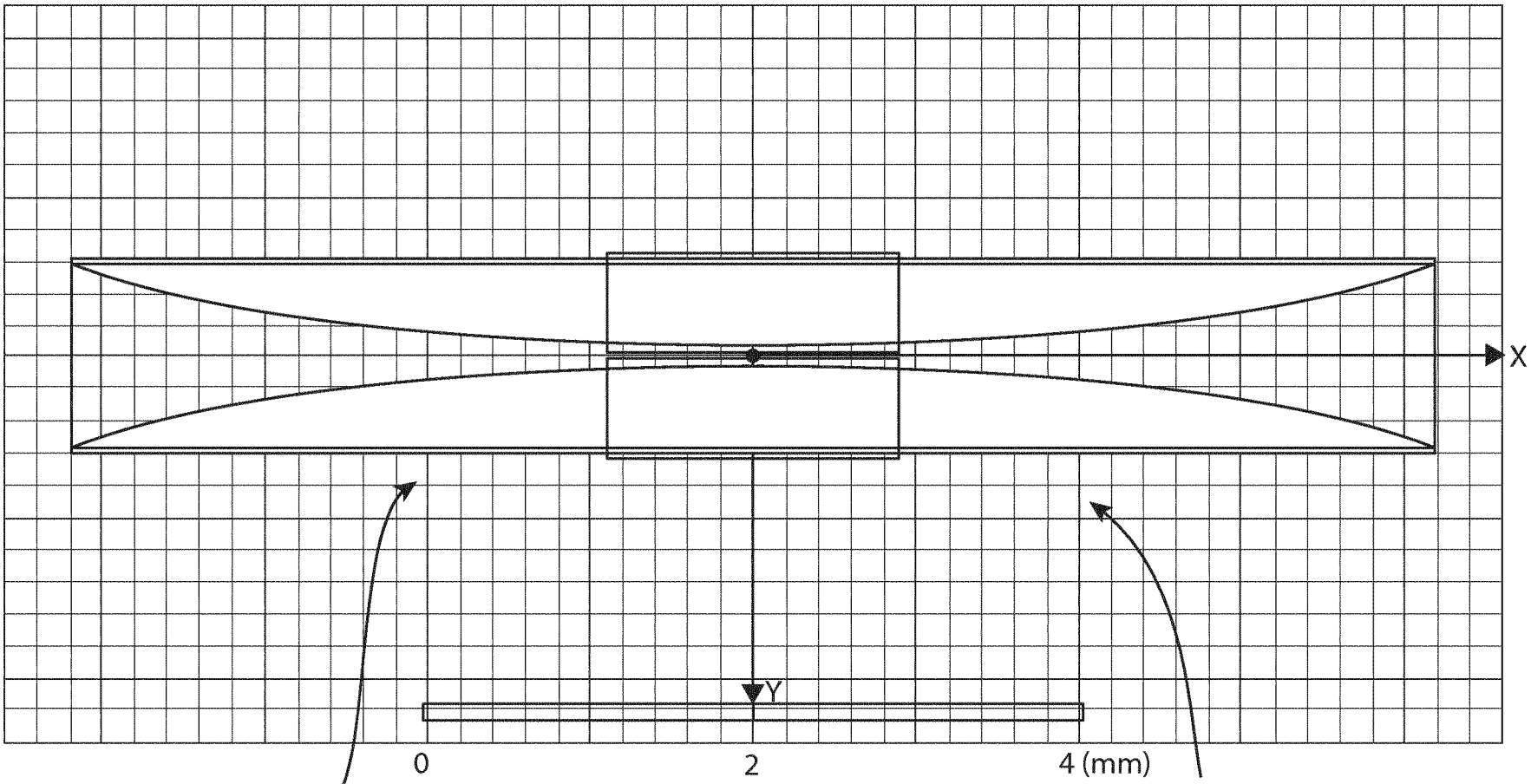
FIG. 12 shows two transitions of the present invention configured to operate as a filter.
Figure 13:
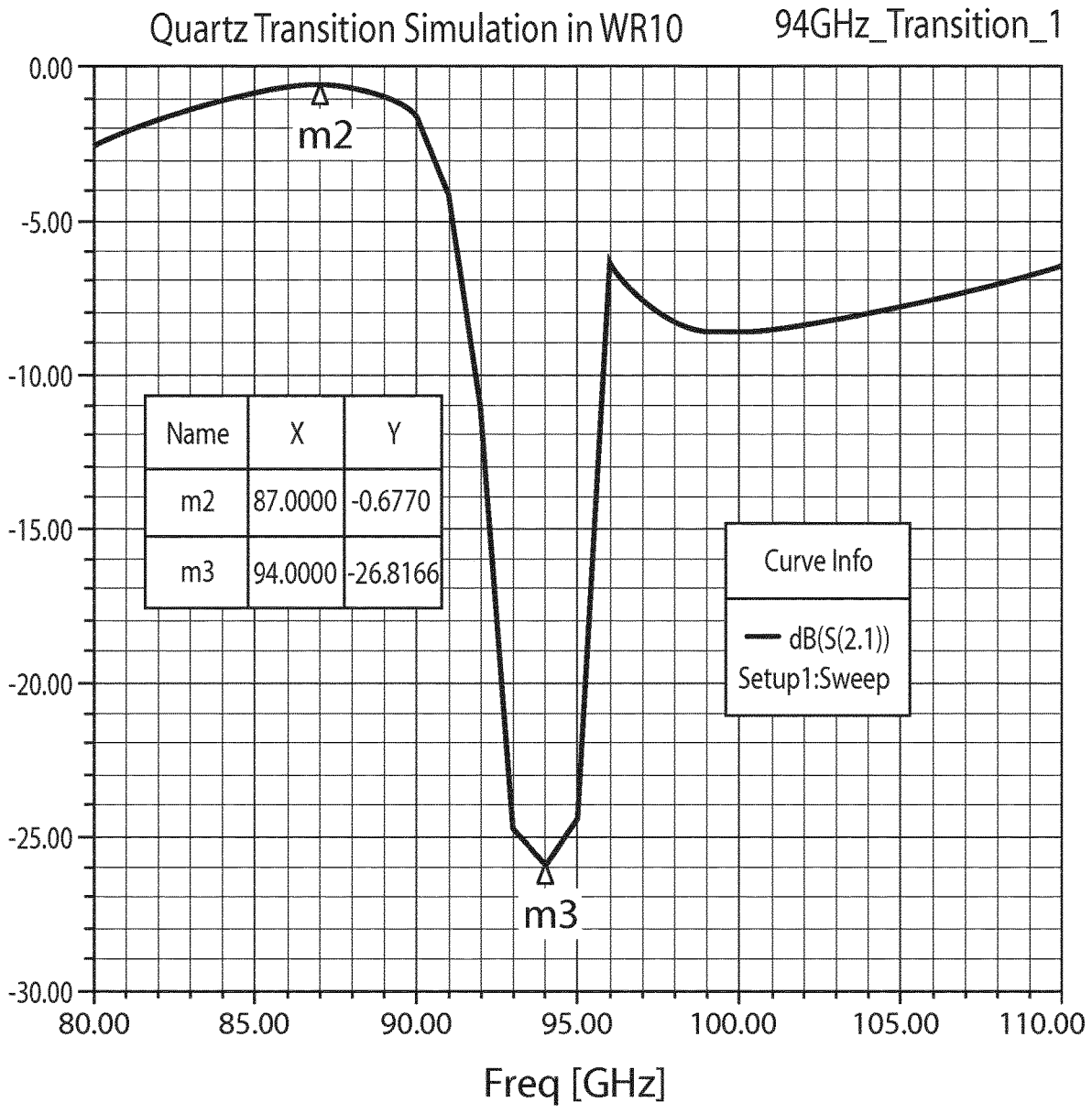
FIG. 13 shows the frequency response of the filter of FIG. 12.

FIG. 12 shows an example of where two transitions of the present invention are mounted back to back, in order to realise a filter. This filter can provide a high quality (Q) value, and can be implemented in microstrip. Alternatively, the filter can be dropped into a waveguide, in order to restrict its frequency band. FIG. 13 shows the frequency response of such a filter implemented in microstrip.

The present invention provides numerous advantages when compared to conventional transitions for mmwave circuits. Firstly, the transition of the present invention is extremely flexible, due to the fact that its frequency response is tuneable. By tuning to the frequency of interest, the transition also provides a filtering effect. In addition, the transition provides good out of band attenuation. The performance of the transition of the present invention is also superior to the performance of conventional transitions, as its frequency tuning capabilities results in lower losses. Furthermore, as a result of the profile of the tapered slot antenna being determined by the use of multiple equations, the present invention enables the size, loss and bandwidth of the transition to be manipulated.

As the transition is in line or symmetric, it also facilitates mmwave/sub mmwave system manufacture, when compared to conventional transitions which require insertion into the side of a waveguide. It also enables the transition to be more easily assembled into a waveguide system, as well as more readily available for tuning.

The transition of the present invention can also be manufactured independently, and easily tuned to a desired frequency, depending on the application with which it is to be used. The transition can be mounted to a carrier to form a sub-system module. The transfer of this module onto a waveguide can be performed with ease, by means of screwing the carrier onto the waveguide. Furthermore, the carriers which can be used with the transition enable a simpler volume manufacture of mmwave systems. Thus, through the use of the transition of the present invention, the implementation of mm wave/sub mmwave waveguide circuits using a carrier system is simplified.

The transition of the present invention is suitable for use with any mmwave/sub mmwave circuit for transferring conductor signal energy to a waveguide and vice versa. Accordingly, the transition has uses in a wide range of applications, such as for example as a mmWave switch module for a frequency modulated continuous wave (FMCW) radar system, or for radio communications systems modules.

The invention claimed is:

1. A transition for millimetre wave circuits, comprising:

a tapered slot antenna with a tapered slot;

a microstrip feed line coupled to the tapered slot antenna; and a set of tuning pads electrically coupled to the microstrip feed line so as to provide a tunable frequency response;

wherein the tapered slot comprises a curved taper, wherein the tapered slot comprises a short-circuit end adjacent the microstrip feed line and a radiating end, and the tapered slot tapers outwardly from the short-circuit end towards the radiating end, and wherein a profile of the curved taper is defined by the use of at least two different equations each associated with a curved expression.

2. The transition of claim 1, wherein the microstrip feed line is located in-line with the direction of the tapered slot of the tapered slot antenna.

3. The transition of claim 1, wherein the profile of the curved taper is defined by the use of the following three equations:

$$f(x)=a/(1+e^{-b(x-c)}) \quad \text{1 Curved Expression}$$

$$f(x)=ke^{l(x)}+n \quad \text{2 Curved Expression}$$

$$f(x)=mx+C \quad \text{3 Linear Expression}$$

wherein f(x) and x correspond to distances from a zero plane, wherein a, b, c, C, m, n are respective constants, and l(x) is a function of x, wherein equation 1 defines a point of inflection, and wherein the curved taper is defined by adjusting the curve above the point of inflection of equation 1 to curve upwards using equation 2, and the curve below the point of inflection of equation 1 to be integrated into the short circuit end of the tapered slot using equation 3.

4. The transition of claim 1, wherein the microstrip feed line comprises a main microstrip feed line coupled to an open circuit impedance stub.

5. The transition of claim 4, wherein the set of tuning pads comprise: a first set of tuning pads located adjacent to the main microstrip feed line, wherein a center frequency and a frequency band of the transition is tunable by selective coupling of the first set of tuning pads to the main microstrip feed line.

6. The transition of claim 5, wherein the set of tuning pads further comprises: a second set of tuning pads located adjacent to the open circuit impedance stub, wherein an insertion loss in the frequency band is fine tunable by selective coupling of the second set of tuning pads to the open circuit impedance stub.

7. The transition of claim 6, wherein the first and second sets of tuning pads are selectively coupled to the microstrip feed line by means of wire bonding.

8. The transition of claim 1, wherein the transition is formed on a planar substrate.

9. The transition of claim 8, wherein the microstrip feed line is formed on a top conductive pattern of the substrate, and the tapered slot antenna is formed on a bottom conductive pattern of the substrate.

10. A waveguide sub-system for mounting onto a waveguide channel comprising:

a transition of claim 1 mounted to a carrier.

11. The waveguide sub-system of claim 10, wherein active devices are mountable to the carrier.

12. A filter comprising:

a first transition of claim 1; and a second transition of claim 1;

wherein the first transition and the second transition are mounted back to back onto a microstrip.

* * * * *